US009463909B2

(12) United States Patent
Brandriff et al.

(10) Patent No.: US 9,463,909 B2
(45) Date of Patent: Oct. 11, 2016

(54) CAP ASSEMBLY WITH INTEGRATED LINER AND OUTER SHELL

(71) Applicants: Robert Brandriff, Brooklyn, CT (US); Charles Bentley, Woodstock, CT (US); Christopher LePine, Brooklyn, CT (US)

(72) Inventors: Robert Brandriff, Brooklyn, CT (US); Charles Bentley, Woodstock, CT (US); Christopher LePine, Brooklyn, CT (US)

(73) Assignee: Colt's Plastics Co., Inc., Dayville, CT (US)

( * ) Notice: Subject to any disclaimer, the term of this patent is extended or adjusted under 35 U.S.C. 154(b) by 248 days.

(21) Appl. No.: 14/067,715

(22) Filed: Oct. 30, 2013

(65) Prior Publication Data

US 2015/0114967 A1 Apr. 30, 2015

(51) Int. Cl.
*B65D 41/04* (2006.01)
*B65D 41/34* (2006.01)

(52) U.S. Cl.
CPC ..... *B65D 41/0442* (2013.01); *B65D 41/045* (2013.01); *B65D 41/0457* (2013.01)

(58) Field of Classification Search
CPC ..... B65D 41/0435; B65D 41/045; B65D 41/0492; B65D 53/04; B65D 41/0442; B65D 41/0457
USPC ..... 215/341, 349, 350, 351, 334
See application file for complete search history.

(56) References Cited

U.S. PATENT DOCUMENTS 4,128,184 A * 12/1978 Northup ..... B65D 41/06 215/222
4,238,042 A * 12/1980 Hatakeyama ..... B65D 41/28 215/334
4,261,475 A * 4/1981 Babiol ..... B65D 41/0435 215/341
4,308,965 A * 1/1982 Dutt ..... B65D 41/0442 215/345
4,405,053 A * 9/1983 Cherot ..... B65D 1/0238 215/331
4,423,821 A * 1/1984 McIntosh ..... B65D 41/045 215/329
4,674,642 A * 6/1987 Towns ..... B29C 45/16 215/230
5,016,771 A * 5/1991 Finneran ..... B65D 51/002 215/247
6,591,998 B2 * 7/2003 Haynes ..... A61F 2/24 206/438
6,761,275 B1 * 7/2004 McBride ..... B65D 53/04 215/349
6,874,647 B2 * 4/2005 Bloom ..... B65D 51/145 215/276
7,874,441 B2 * 1/2011 Bloom ..... B65D 51/145 215/276

* cited by examiner

*Primary Examiner* — J. Gregory Pickett
*Assistant Examiner* — Niki M Eloshway
(74) *Attorney, Agent, or Firm* — Andrew C. Aitken

(57) ABSTRACT

A cap assembly for a container that includes an outer-shell and an inner-element that is received within the outer shell. The outer shell includes a recess on the interior surface of a top portion and the recess includes a top flange section that restricts the opening. The recess receives a complementary end wall that extends from the inner-element and which has a lip that mechanically locks within the recess thereby keeping the shell and liner together. In embodiments a clutch plate is positioned between the shell and liner.

14 Claims, 13 Drawing Sheets

CAP ASSEMBLY WITH INTEGRATED LINER AND OUTER SHELL

BACKGROUND OF THE INVENTION

Threaded caps have been in common use as closures for the capping of jars, bottles, and similar containers for many years. Typical cap construction is often as a single metal or molded plastic closure or as a combination of two or more components to achieve specific functional or performance characteristics. In typical embodiments the caps are fitted with an additional sealing gasket material, or "liner" in industry parlance, and then threaded tightly onto a container to prevent leakage as well as to aid in the preservation of the contents. This lining or gasket material then becomes the second component in a one-piece cap or the third component in a two-part cap.

For both aesthetic and functional reasons, two-part caps are often constructed with an inner cap and outer shell cover with these two components of the same or of different materials. The inner-cap typically contains internal threads to allow a screw closure onto a container and is fabricated from a material with desirable physical and chemical resistant properties for the specific end-use or product application. The outer cover is often formed of a more rugged material for physical protection of the container and contents and/or a material which may be more aesthetically appealing.

While two-part caps are routinely used as closures, the two piece construction technique is sometimes problematical due to spurious physical relative rotation of the respective parts or the separation of the inner-cap from the outer cover. Either of these common modes of failure results in undesirable and often unacceptable product performance.

One conventional prior art cap is constructed from a molded plastic cap that is then covered with a formed metal over-shell. In another prior art embodiment, a plastic inner-cap is inserted into an outer cover that is molded from a different plastic resin. In these and similar prior art embodiments, the inner and outer components are typically held in relative position by simple frictional engagement. In an alternative arrangement, the frictional engagement between the inner and outer components is further enhanced with minimal mechanical interference tabs or points. Adhesive may also be used in some constructions to augment the frictional and/or mechanical interference engagement. Thus, typical two-piece construction caps rely upon limited frictional and/or minimal mechanical interference possibly augmented with adhesive, to resist unwanted separation or relative rotation.

In all of these arrangements the connection between the outer and inner components must resist the substantial rotational torque occurring during removal and replacement of the cap assembly on a container, as well as tensile loads occurring during normal handling of the package. Since many applications may involve the repeated opening and closing of the containers, the components and their performance must remain constant over time to allow the closure to function effectively through extended use and in a wide range of service conditions.

It is therefore an object of the invention to provide an improved two part cap wherein an inner-element and outer-shell are held firmly together as to provide a structure with reliable and consistent performance.

BRIEF SUMMARY OF THE INVENTION

The present invention is directed to a cap for a container that includes a mechanical locking engagement between an inner-element and an outer-shell. Another aspect of this invention allows either the inner element or the outer shell to function as the threaded closure, with the inner element available for additional functions when the outer-shell is utilized as the cap. A central advantage of the locking feature concept is the diminishment of the possibility of separation during routine use. The locking feature described herein also creates significant additional interference forces between the engaged sections of the two components, thereby developing a very high frictional resistance to rotation. Due to the deformable nature of the materials commonly used for caps, in the absence of the locking feature the interference loading may tend to force separation of the two components and thereby defeat the desired objective.

DETAILED DESCRIPTION OF EMBODIMENTS OF THE INVENTION

Figure 1:
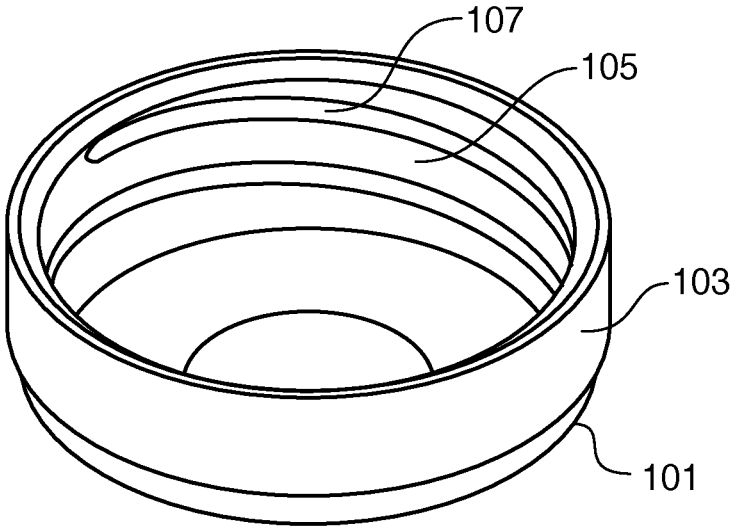
FIG. 1 is a perspective view of a first embodiment of a completed cap assembly that includes an inner-element inserted and locked into position within an outer-shell.

Now referring to FIG. 1, a completed cap assembly 101 is depicted that includes inner-element 105 inserted and seated into outer-shell 103. Inner-element 105 further includes threads 107 that are integrated to the inner sidewall 105 and are designed to engage opposite threads provided on a container such as a bottle.

Figure 2:
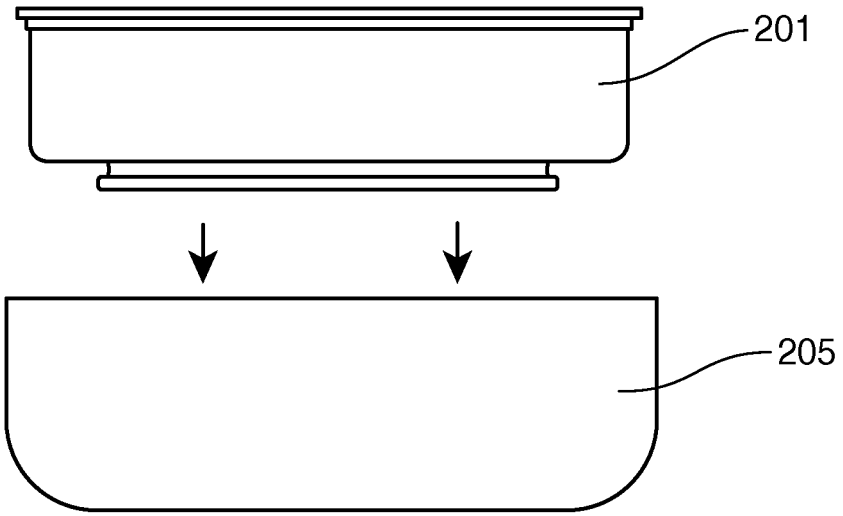
FIG. 2 is a side view in elevation depicting the inner-element in alignment with the outer-shell before assembly of the first embodiment.
Figure 3:
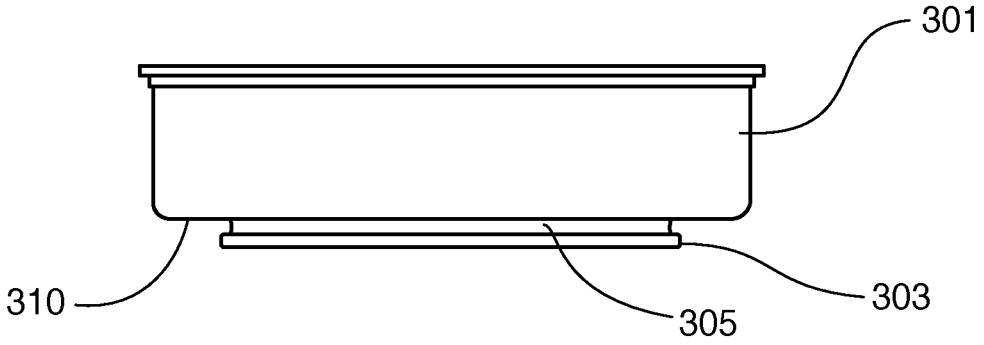
FIG. 3 is a side view in elevation of the inner-element of the first embodiment.

As shown in FIG. 2, to assemble the inner-element 201 and outer-shell component 205 sufficient rectilinear force is utilized to seat the inner-element 201 into position within a seat provided within outer-shell 205. When seated, the mating retention surfaces associated with the seat then forms a mechanical locking engagement, and when combined with the interference fit of these retention surfaces, assure a secure engagement. FIG. 3 illustrates an annular cylindrical extension 305 that extends from a top panel 310 of the inner-element. At the distal end of extension 305 a flange or lip 303 extends in a radial direction and is substantially parallel with a plane formed by top panel 310 of the inner-element 301.

Figure 4:
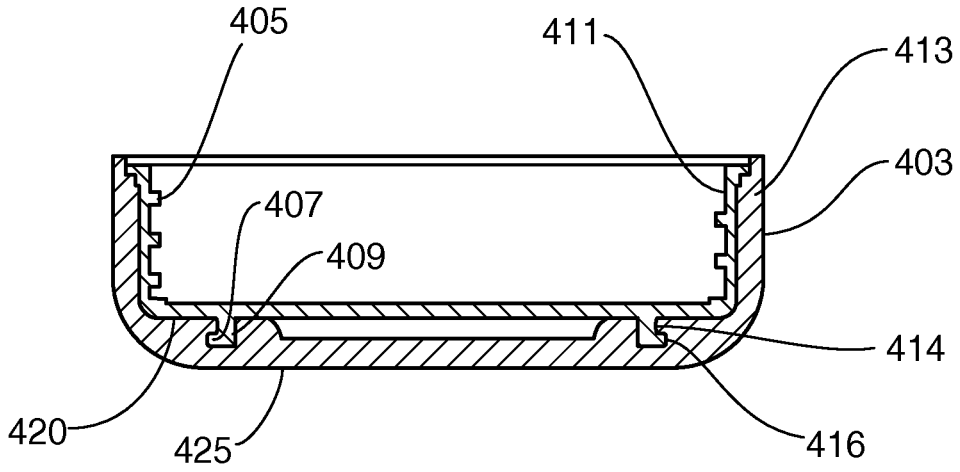
FIG. 4 is a sectional side view in elevation of the inner-element seated with an outer-shell according to the first embodiment.

As best seen in FIG. 4, the engagement between outer shell 403 retention lip 414 and flange section 407 of the inner-element 402 forms a positive mechanical interlock to resist possible tensile separation. The positive mechanical locking action further allows a significant interference fit between the recess surfaces 416 and the annular cylindrical end wall insert 409 that includes lip region 407 thereby establishing a frictional torque resistance. (Note that for visual clarity, space is shown between some portions of the interlocking components in FIG. 4.) In the absence of the mechanical interlock as disclosed herein, the interference forces could, over time, tend to force separation of the inner-element and outer-shell and thereby defeat the desired objective.

To facilitate manufacturing and assembly, recess 416 in the embodiment depicted in FIG. 4 is circular and concentric to the centerline of the parts. However, the mating recess can be elliptical or another non-circular geometric shape so that the shear strength of the materials further resists rotational forces where very high performance is required. These shapes may include squares, rectangular and ovals. A limited and minimal amount of adhesive can also be used to augment both the mechanical interference and frictional resistance forces between the shell and liner, and to also reduce stress concentration within the materials to further lessen the opportunity for material failure under extremely high loading in demanding applications.

The locking surfaces 414 and 407 are parallel with the end panel 420 of inner-element and the top surface 425 of the outer-shell. It is further contemplated that alternative designs are feasible that will position the locking surfaces at other positions within the horizontal surfaces and may also include additional locking surfaces along the vertical sidewalls of the parts. Similarly, a plurality of locking arrangements can be utilized in a single assemble when demanded by application requirements.

Thus, the embodiment disclosed in FIG. 4 includes an assembly of an outer-shell and an inner-element utilizing a retention end wall insert 409 that extends within a recess 416 of outer-shell 403 that acts to receive the end wall insert 409 and integral extended lip 407. Inner-element extended lip 407 therefore includes a retention ridge that locks behind the flange 414 of the outer-shell recess. In the embodiment depicted in FIG. 4 the part includes outer-shell 403 having a top flat end plate 425 and a skirt 413 comprising a cylindrical sidewall that extends from the top end panel 425. An inner-element 402 is received within the outer shell which has a top panel 420, a smooth exterior cylindrical sidewall and a thread 405 on the interior sidewall 411. Extending from the top panel is top annular end wall insert 409 that includes the integral lip 407. The lip extends radially outward in a generally perpendicular direction from the top annular end wall insert 409 and is generally parallel with the top surface 420 of the inner-element.

In a preferred embodiment the outer-shell is comprised of urea, a thermosetting resin. Most thermoset resins are generally characterized by their hardness, rigidity and resistance to surface scratching. Other thermosetting resins that may be used for the outer-shell of the present invention include: polyester resin, vinyl ester resin, epoxy resins, phenolic resins and urethane.

In the preferred embodiments the inner-element is made of a polypropylene, a thermoplastic resin. Thermoplastic resins are generally softer than thermosetting resins, and more resilient and flexible. In alternative embodiments the resin is made from PET, polypropylene, polycarbonate, PBT, vinyl, polyethylene, HDPE, PVC, PEI, and nylon.

In a further embodiment of the invention, the outer-shell is made of metal that has a relatively high degree of rigidity and hardness compared to the inner-element.

The respective force that is required to insert and lock the flange into its complementary groove provided on the outer-shell is dependent on both the dimensions of the lip on the annular extension from the inner-element and the flange member that surround the complementary recess on the outer-shell and the respective materials that are used to make the inner-element and outer-shell.

Figure 5:
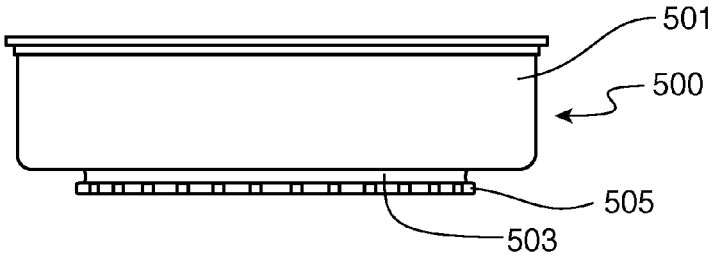
FIG. 5 is a side view in elevation of a second embodiment of the inner-element.
Figure 6:
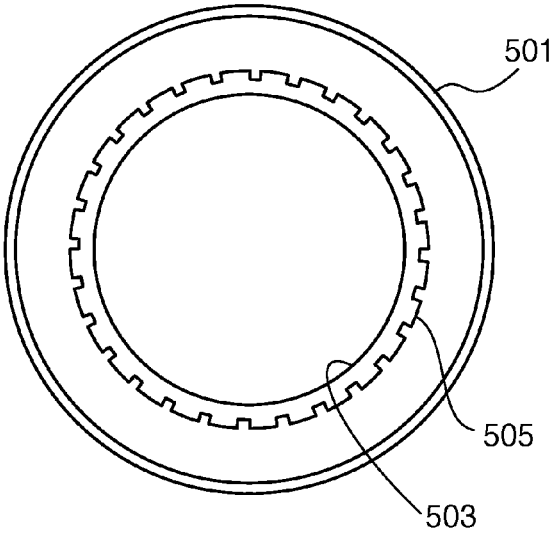
FIG. 6 is a top plan view of the second embodiment of the inner-element.

Referring now to FIGS. 5 and 6, in a further alternative embodiment of an inner-element 500 includes lip member 505 that extends from top annular end wall insert 503 is not a continuous segment but rather comprises of a series of cantilevered arcuate or cordial sections. These segments extend from annular end wall insert 503 that extend from the top surface 509. It should be appreciated that the number and size of the flange sections may be adjusted to alter the performance features of the parts. For example, as the space between adjacent flange cordial sections is increased, the force that is required to insert the flange into the groove is diminished.

Figure 7:
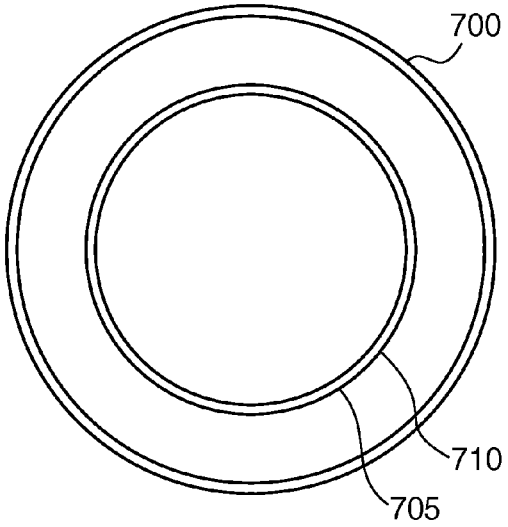
FIG. 7 is a top plan view of a third embodiment of the inner-element.
Figure 8:
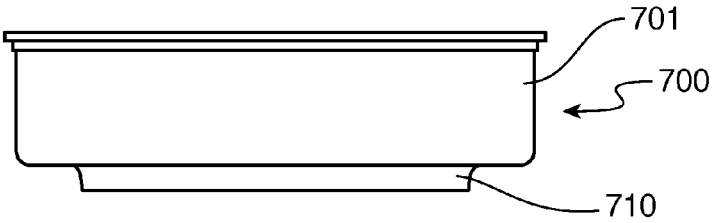
FIG. 8 is a side view in elevation of the third embodiment of the inner-element.
Figure 10:
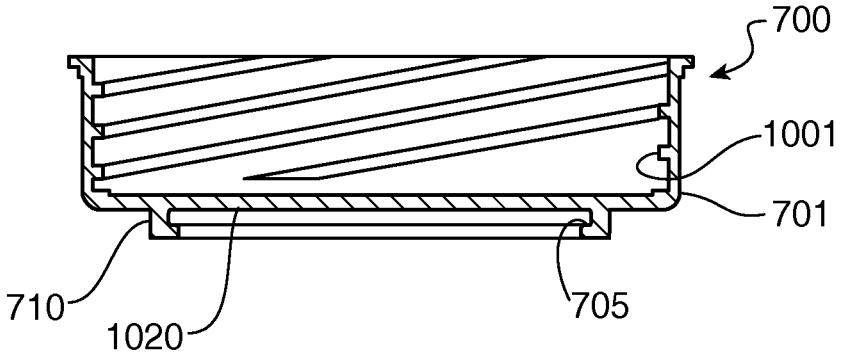
FIG. 10 is a side view in elevation of the embodiment depicted in FIG. 8.

Now referring to FIGS. 7 and 8 and 10 in a further embodiment of the invention the inner-element 700 has a lip 712 that extends inwardly from the top annular extension sidewall 710 and toward the central axis of the cap. FIG. 10 depicts a sectional view of inner-element 700 that includes threads 1001, the lip 712 and end wall insert 710.

Figure 9:
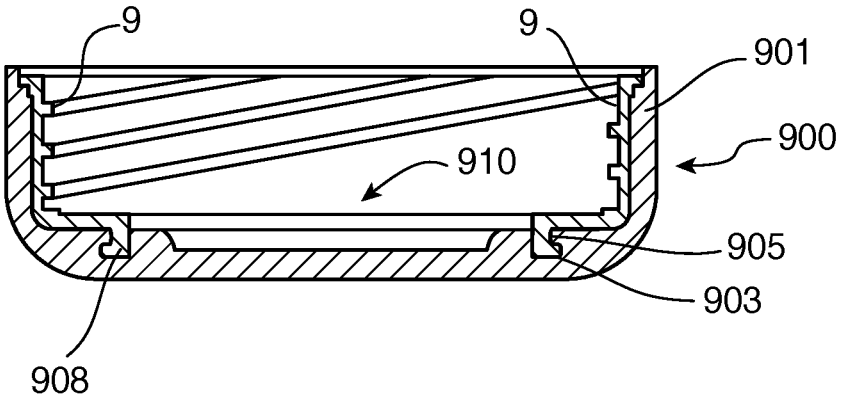
FIG. 9 is a side sectional view of a forth embodiment of an inner-element seated in an outer-shell.

FIG. 9 depicts an alternative embodiment of annular inner-element that has a central aperture region 910 through the top panel 925. In this embodiment an annular bottom surface 930 can be designed to engage the top surface of a container and form a mechanical seal with a container or bottle. Other features of the assembly depicted in FIG. 9 are similar to the previously described embodiments including a cylindrical sidewall 902 of the inner-element that is in engagement with the skirt 901 of outer shell 900. The inner-element includes threads 918 that are designed to engage opposite threads on a container. The outer-shell 900 includes a recess 903 that received an end wall 908.

In yet a further contemplated embodiment (not shown), the lip that projects from top annular end wall insert member is not directly perpendicular. In this regard, the angle that the flange portion extends from the end wall insert member may be slightly adjusted to extend at a slight angle with respect to the outer-shell bottom surface and inner-element top panel. For example, the flange may be angled downward from the distal end of the end wall insert toward the panel surface of the inner-element. Adjusting the angle of the lip may facilitate the snap fit procedure within the annular recess provided on the bottom surface of the outer-shell. In each of the embodiments depicted wherein, the lip member and flange member have rectangular shaped profiles. It is further contemplated that in alternative embodiments, the lip and or flange may have rounded engagement surfaces that would also facilitate the engagement between the lip and flange structures.

As discussed above, and as best seen in FIGS. 5 and 9, the flange members of the outer-shell serves to mechanically lock the inner-element within the outer shell and provides additional surface area between the inner-element and outer-shell that enhances the interference fit between the components which resists separation caused by torque forces.

Figure 11:
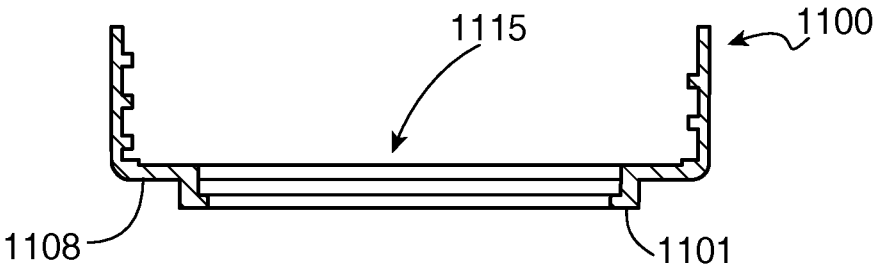
FIG. 11 is a side sectional view of a further embodiment of an inner-element.

Now referring to FIG. 11, yet a further embodiment of an inner-element is depicted that includes a central round aperture 1115 through top panel 1108. The inner-element includes an annular sealing surface 1120 that is designed to engage a top annular end of a container. The embodiment depicted in FIG. 11 includes an end wall insert 1101 that has a flange that extends in a direction toward the central axis of the part.

Figure 12:
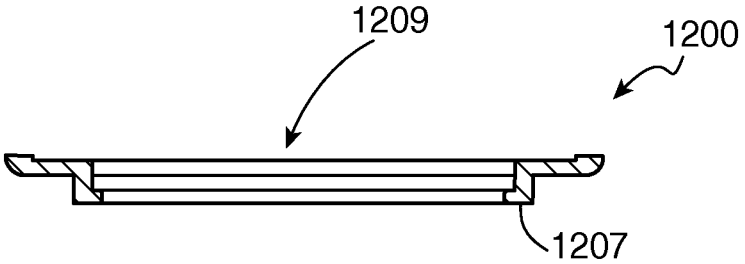
FIG. 12 is a side sectional view of yet a further embodiment of an inner-element.
Figure 13:
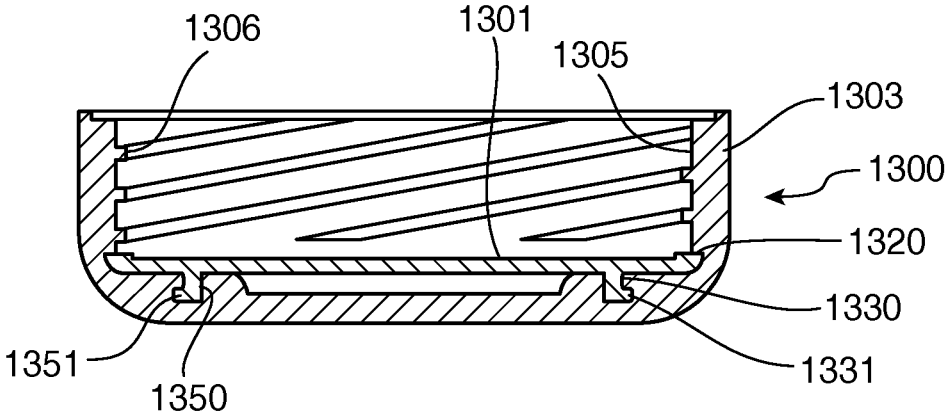
FIG. 13 is a side sectional view of a further embodiment of an inner-element seated in an outer-shell.
Figure 14:
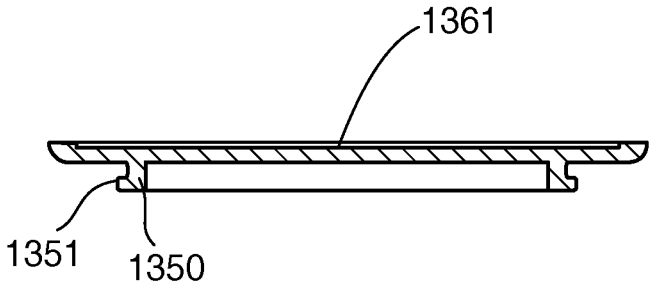
FIG. 14 is a side section view of the inner-element depicted in FIG. 13.
Figure 15:
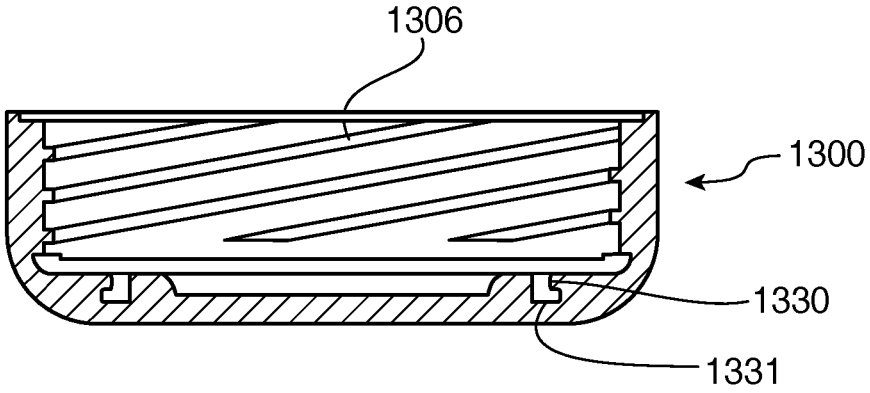
FIG. 15 is a side sectional view of the outer-shell depicted in FIG. 13.

FIGS. 12-15 depict yet further embodiments of the invention wherein the inner-element does not include cylindrical sidewalls. It should be recognized that the problem of separation of the inner-element from the shell is less critical in these applications because there are only limited torque forces between the inner-element and outer-shell. FIG. 12 depicts inner-element 1200 including a planer panel 1250 from which end wall insert 1207 extends from a top surface 1255. The end wall insert 1207 is designed to engage a complementary recess in an outer-shell. FIGS. 13-15 depict a further embodiment including wherein the outer-shell comprises a skirt 1303 that has threads 1306 provided in the inner walls 1305 of the skirt 1303 for engagement with a container. The inner-element includes end wall 1350 on which a lip 1351 extends in a direction radial from the central axis and is substantially parallel with the bottom surface of inner-element 1301. End wall 1350 is received in recess 1331 and locked in place by the engagement of flange 1330 and lip 1351.

Figure 16:
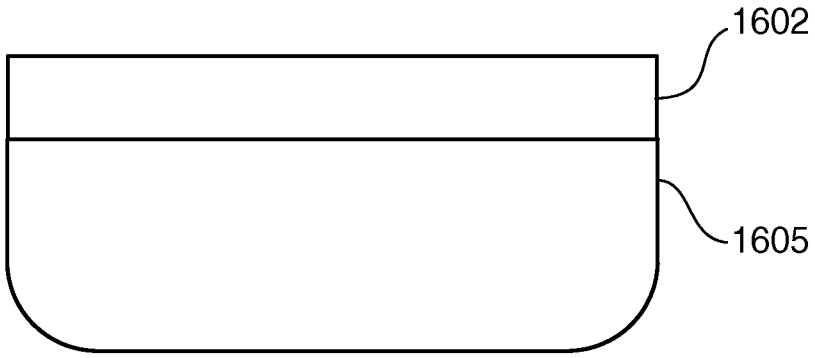
FIG. 16 is a side view in elevation of a further embodiment of the invention.
Figure 17:
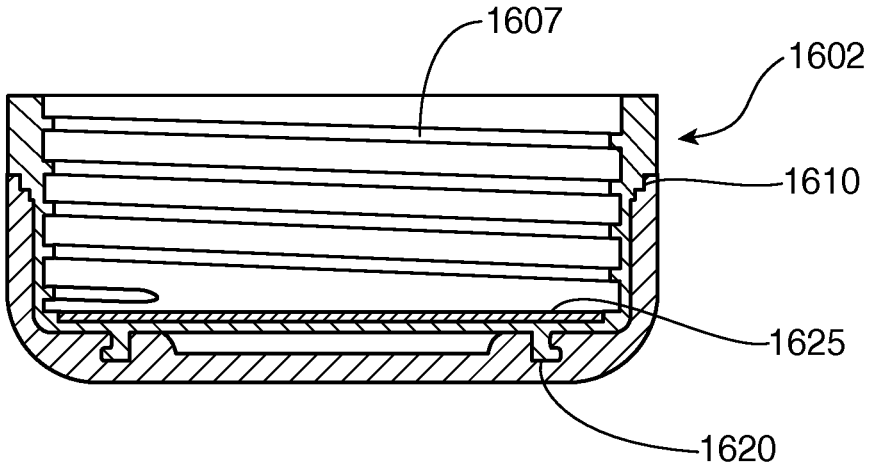
FIG. 17 is a side sectional view of the embodiment of FIG. 16.

Now referring to FIG. 16, in an alternative embodiment of the invention, the inner liner section 1602 extends from the outer shell 1605 and has approximately the same circumferential diameter as the skirt section of the outer shell. The inner liner 1602 is seated at location 1610 and at the top annular sidewall 1620. This embodiment has the advantage of allowing the appearance of the cap to have two colors wherein the liner is made of a first material having a first color and the outer shell is made of a second material having a second color. As seen in FIG. 17, the embodiment of FIGS. 16 and 17 includes internal threads 1607 provided on the inner liner side wall. Also depicted is sealing surface 1625 that is made from a resilient material and when tightly engaged with the top annular opening of a container, will make a seal. The embodiment depicted in FIGS. 16-17 permit the use of different colors for the cap and can provide for complementary surface finishes that cannot be accomplished in a single molded part.

Figure 19:
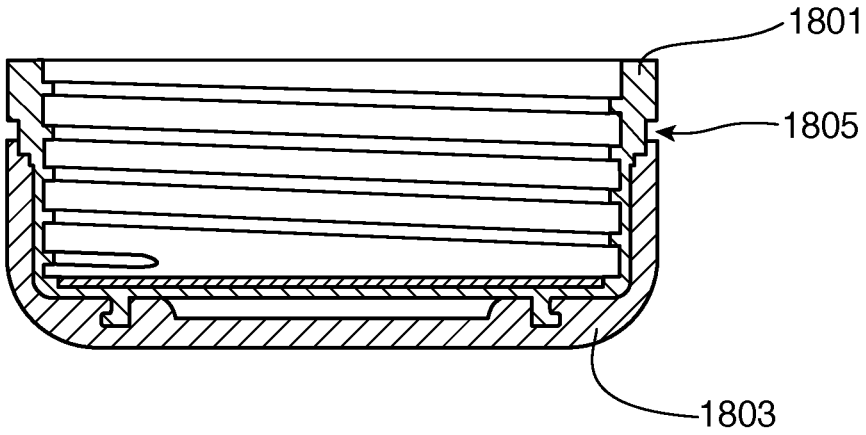
FIG. 19 is a side sectional view of the embodiment depicted in FIG. 18.
Figure 20:
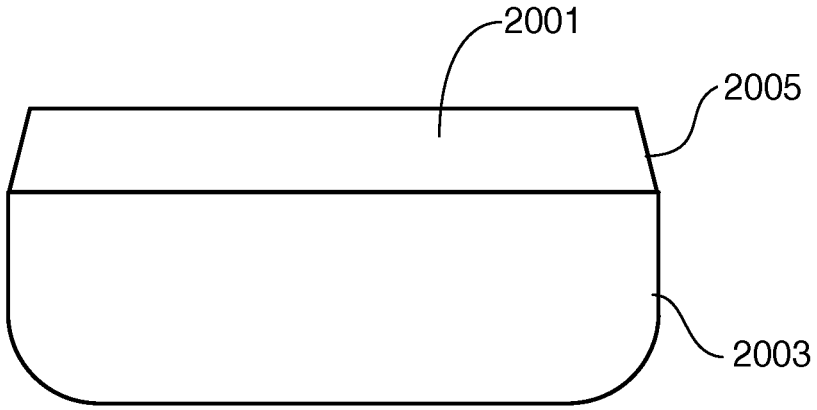
FIG. 20 is a side view in elevation of a further embodiment of the invention.

The embodiment depicted in FIGS. 19 and 20 is similar to that depicted in FIGS. 16-17 and includes inner liner 1801 and outer shell 1803 and further includes an annular undercut groove 1805 that surrounds the exterior surface. Annular groove 1805 not only provides an ornamental feature but increases the surface area to allow a user to improve manual engagement of the cap and exert a torque force for opening and closing a container. The three dimensional surface groove structure that is created on the part would be difficult to create using conventional molding manufacturing techniques. In yet further embodiments, the surface of the inner element extension area can be provided with facets or other surface structures to provide an improved gripping surface. The inner liner can also be made of a material that has a higher friction coefficient than the outer shell to allow for improved handling, opening and closing.

Figure 18:
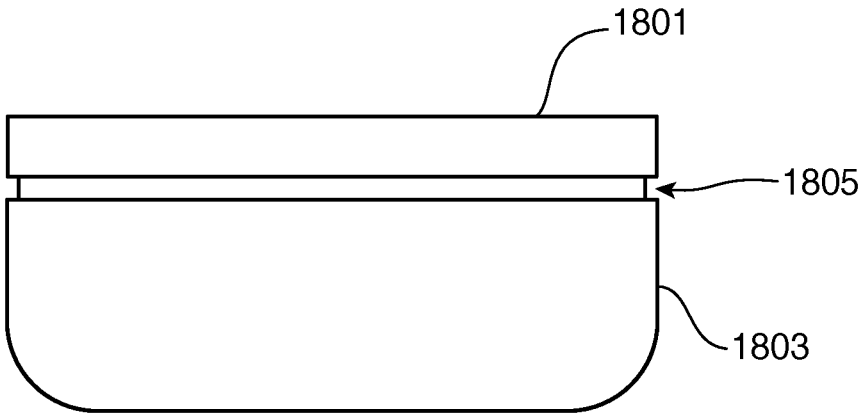
FIG. 18 is a side view in elevation of a further embodiment of the invention.
Figure 21:
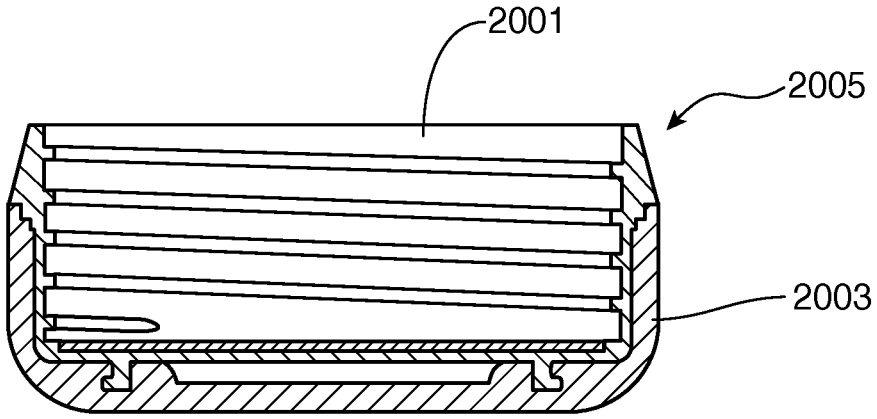
FIG. 21 is a side sectional view of the embodiment depicted in FIG. 20.

FIGS. 20 and 21 depict yet a further embodiment wherein the inner liner tapers toward the central axis at region 2002. This structure has an inner liner and outer shell that are engaged in the same manner as described above with respect to FIGS. 18-19. This cap may be used in connection with a security seal or heat shrink seal that spans the cap and container, wherein the edge on the cap is diminished and the space immediately below the cap along the exterior sidewall of the container is reduced. As such, the profile of the device is streamlined. Security seals are designed to tear away in response to manual manipulation and are intended to ensure that the contents of the container have not been tampered with.

Figure 22:
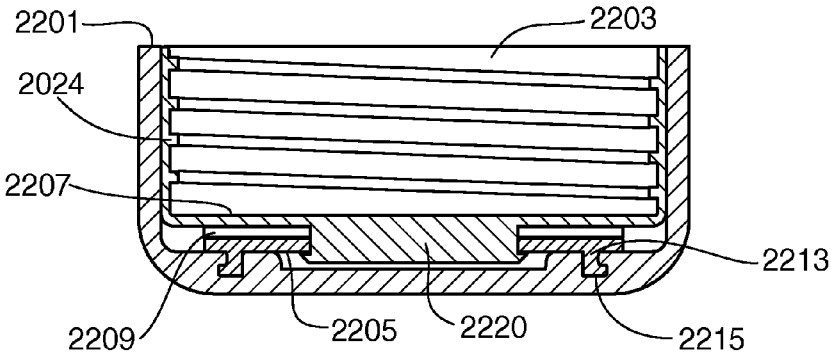
FIG. 22 is a side sectional view of a further embodiment of the invention that includes a clutch plate feature in a disengaged position.
Figure 23:
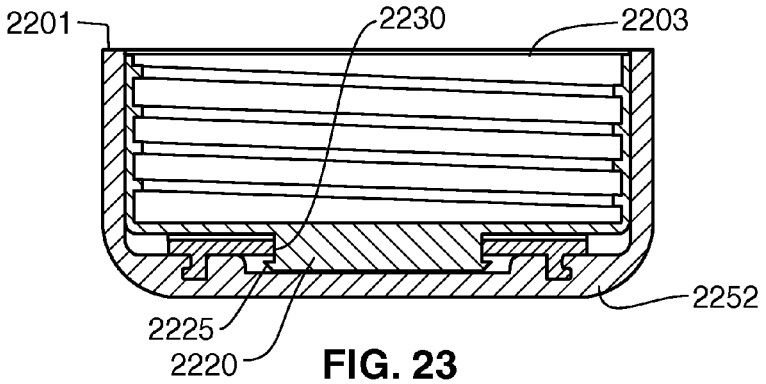
FIG. 23 is a side sectional view of the embodiment of FIG. 22 with the clutch plate engaged.
Figure 24A:
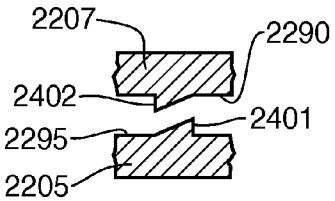
FIG. 24*a* depicts an enlarged sectional view of the clutch plate and the inner liner with the parts disengaged.
Figure 24B:
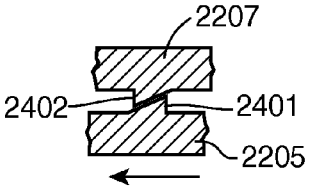
FIG. 24*b* depicts an enlarged sectional view of the clutch plate and the inner liner with the parts engaged and rotated in a first direction wherein the teeth will slide over one another.
Figure 24C:
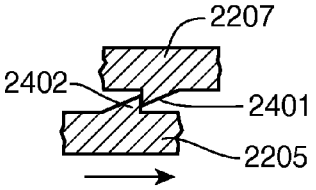
FIG. 24*c* depicts an enlarged sectional view of the clutch plate and the inner liner with the parts engaged and rotated in a second direction wherein the teeth will engaged one another.
Figure 24D:
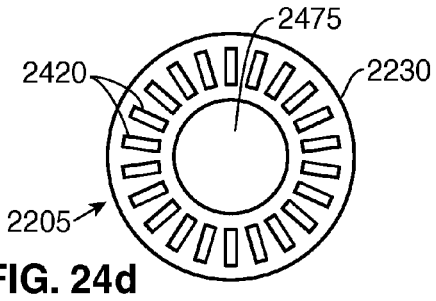
FIG. 24*d* depicts a bottom view of the clutch plate according to the embodiment depicted in FIGS. 22-24.
Figure 24E:
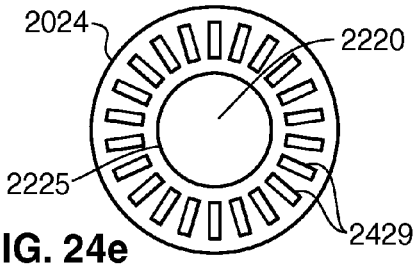
FIG. 24*e* depicts a top view of the inner liner top surface according to the embodiment depicted in FIGS. 22-24.

FIGS. 22 through 24 depict a further embodiment of the invention that includes a clutch feature and can be configured as a child resistant cap. In the embodiment depicted in FIG. 22 the clutch plate 2205 is disengaged from top surface 2209 of the top plate section 2207 of inner liner 2203. The cap therefore includes three parts which consist of the outer shell 2201, inner liner 2203 and clutch plate 2205. Annular end wall element 2213 of clutch plate 2205 is received in a corresponding groove 2215 provided in the bottom surface of outer shell 2201. This engagement is similar to that described above. The liner 2201 is retained in place by the engagement of a flange 2225 provided on circular extension 2220 with the annular edge 2230 of clutch plate 2205. The engagement between the liner 2201 and the clutch allows the inner liner 2201 to rotate with respect to the clutch and outer shell. As best seen in FIGS. 24*a-c*, the lower surface 2295 of the clutch 2205 and the upper surface of the plate 2207 are provided with teeth extensions 2401 and 2402 respectively. When force is applied form the top surface 2252 of outer shell 2201, the teeth of the clutch 2220 and the teeth 2429 of the top of the inner liner 2209 can engage each other and therefore the rotation of the outer shell is translated to the inner liner. The bottom of the clutch 2205 is depicted in FIG. 24*d* and includes a plurality of raised teeth 2420 around the center aperture 2475. The central aperture receives the structure 2220 as best seen in FIG. 22. The engagement between the clutch 2205 and top of the inner liner is best seen in FIGS. 244*a-c*. When no force is applied there is a small gap between the clutch teeth 2401 and teeth 2402 provided on the liner. As seen in FIG. 24*b*, when a force is applied to the top surface of the outer shell, the teeth may engage and slide past one another when rotated in a first direction as depicted in FIG. 24*b*. When the rotation is reversed, as depicted in FIG. 24*c* and force is applied to the top surface of the outer shell, the teeth of the clutch engage opposite teeth and translate the rotation movement of the outer shell to the inner liner.

Figure 25:
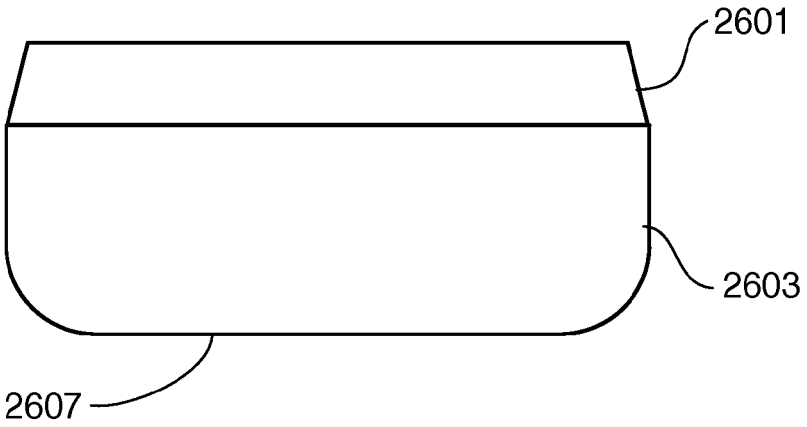
FIG. 25 is a side view in elevation of a further embodiment of the invention.
Figure 26:
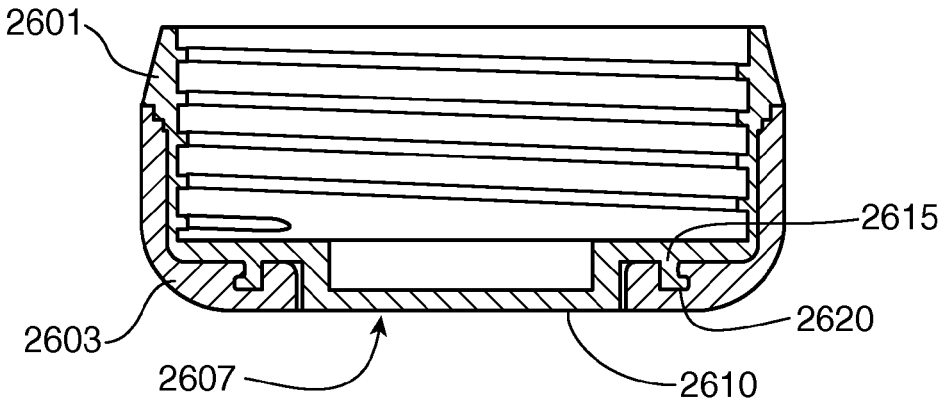
FIG. 26 is side sectional view of the embodiment depicted in FIG. 25.
Figure 27:
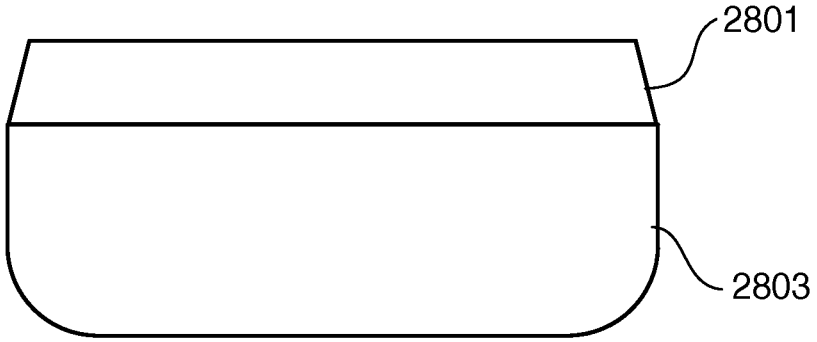
FIG. 27 is a side view in elevation of a further embodiment of the invention.
Figure 28:
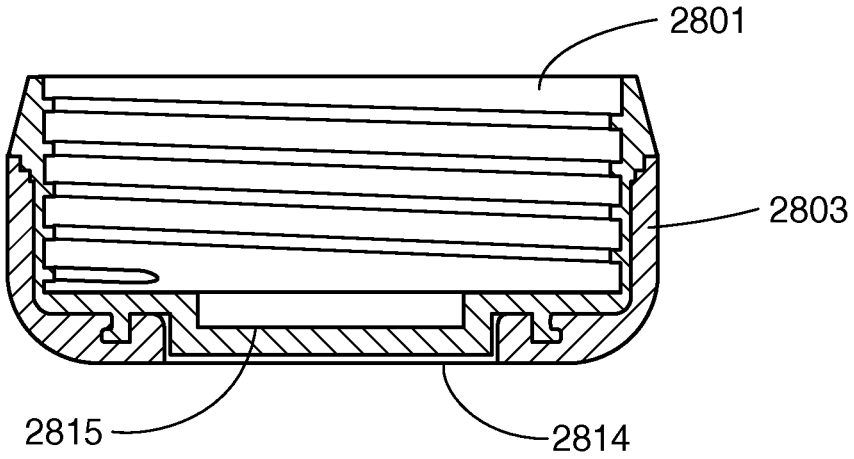
FIG. 28 is a side sectional view of the embodiment depicted in FIG. 27.

Now referring to FIG. 25, in yet a further embodiment, the outer shell 2603 is provided with a central aperture 2607 that can receive a corresponding structure 2610 that extends from the top surface of the inner liner. Like the end wall structure, the extension structure and corresponding aperture can be circular, polygon such as a square, triangle or hexagon, other ornamental shape. Using non circular shapes as the extension structure can therefore lock rotational movement between inner liner 2601 and outer shell 2610. The parts are locked together as using the end wall 2615 and recess 2620 structures. As is apparent by the embodiment FIGS. 25 and 26, the structure 2610 is flush with the top surface of the outer shell. Yet a further alternative embodiment is depicted in FIGS. 27 and 28 wherein a center raised region 2815 is visible in a central opening 2814 of the outer shell 2803. The region 2815 of the inner liner is therefore slightly recessed below the surface 2814 of the top of outer shell 2803.

Figure 29:
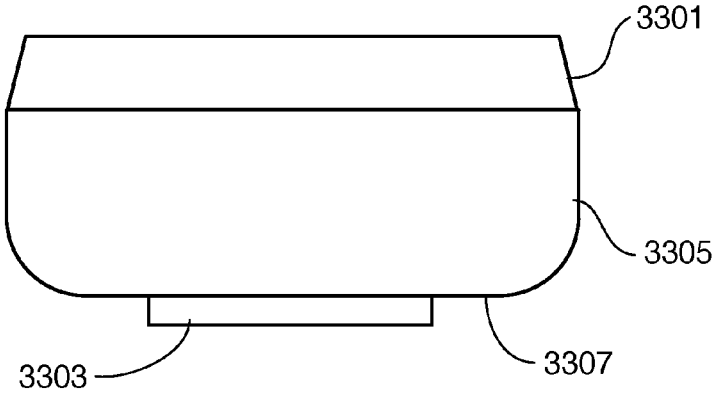
FIG. 29 is a side view in elevation of a further embodiment of the invention.
Figure 30:
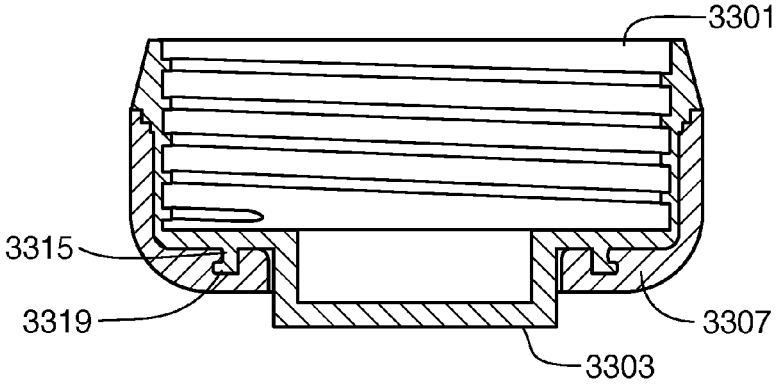
FIG. 30 is a side sectional view of the embodiment depicted in FIG. 29.
Figure 31:
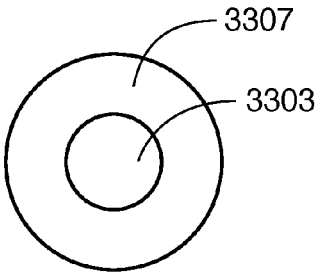
FIG. 31 is a top view of the embodiment depicted in FIGS. 29 and 30.

FIGS. 29 through 31 depict a further embodiment wherein the extension 3303 extends past the top of the outer shell and provides a top surface feature for the device. As discussed above, the extension feature can be circular, or a polygon, other ornamental shapes or even distinctive logos or trademarks. The extension 3330, which is part of the liner 3301, extends above the top surface 3307 of the outer shell 3305. The parts are connected by the engagement of the end wall 3315 into the recess 3319. As depicted in the FIG. 31 the parts may be concentric.

Figure 32:
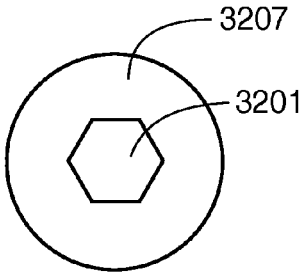
FIG. 32 is a top view of an alternative embodiment of the invention.
Figure 33:
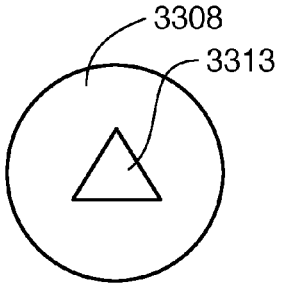
FIG. 33 is a top view of a further embodiment of the invention.

FIGS. 32 and 33 depict yet further embodiments of the invention. The embodiment is similar to that depicted in FIGS. 26 and 27 however elements 3313 and 3207 respectfully are not circular. Thus, element 3207 of FIG. 32 is a hexagon and is surrounded by the outer shell section 3201. Element 3313 has the shape of triangle and is surrounded by the outer shell 3308. The annular recesses and end walls of these embodiments have the same structure as depicted in FIG. 28.

It will be clear to one skilled in the art that the embodiments described above can be altered in many ways without departing from the scope of the invention. Accordingly, the scope of the invention should be determined by the following claims and their legal equivalents.

We claim:

1. An cap assembly for a container comprising an outer-shell member and an inner element, said outer-shell comprising a top portion and cylindrical sidewalls, and an interior surface of said top portion is flat and is provided with a recess channel, said recess channel further comprising two sidewalls and a flange section that restricts an opening of said recess channel, said inner element comprising a panel section, said panel section having a planar top surface and a planar bottom surface, said bottom surface that forms a continuous circular planar section, and said planar top surface further comprising an end wall insert member, said end wall insert member further comprising a lip locking member extending from said end wall insert member sized and shaped to be received in said channel recess and wherein said lip locking member engages said flange section to lock the inner-element to the outer-shell, said inner element further comprising threads, said threads sized and shaped to engage opposite threads provided on a container.

2. The cap assembly recited in claim 1 wherein said recess channel and said end wall insert member are annular.

3. The cap assembly recited in claim 1 wherein said outer-shell is comprised of a material that has a greater hardness than said inner-element.

4. The cap assembly recited in claim 1 wherein said outer-shell comprises a thermoset resin and said inner-element comprises a thermoplastic resin.

5. The cap assembly recited in claim 1 wherein said inner-element comprises a second cylindrical sidewall that extends from said panel section and said second cylindrical sidewall comprises an inner sidewall surface that comprises threads.

6. The cap assembly recited in claim 1 wherein said lip locking member that extends from said end wall insert member is a continuous annular structure and extends from said end wall insert member.

7. The cap assembly recited in claim 1 wherein said lip locking member that extends from said end wall insert member is segmented.

8. The cap assembly recited in claim 1 wherein said lip locking member extend in a radial direction from said end wall insert member.

9. The cap assembly recited in claim 1 wherein said outer-shell comprise urea and said inner-element comprises polypropylene.

10. The cap assembly recited in claim 1 wherein said recess channel further comprising a bottom surface, wherein said sidewalls extend from said top surface.

11. The cap assembly recited in claim 1 further comprising a second recess channel in a bottom surface of said outer shell, said second recess channel having sidewalls and a floor, and a second end wall locking member, said second locking member extending from the top surface of said inner element.

12. The cap assembly recited in claim 1 further comprising an extension member that, when in an assembled position extends from the inner element and into an opening through the top surface of said outer shell.

13. The cap assembly in claim 12 wherein said extension member extends through a top surface of said outer shell, and said extension member comprises an exterior surface that is substantially continuous with the exterior surface of said outer shell.

14. A cap assembly for a container comprising an outer-shell member, an inner-element and a clutch plate, said outer-shell comprising a top portion and cylindrical side-walls, and an interior surface of said top portion is flat and is provided with a recess channel, said recess channel further comprising a top flange section that restricts the opening of said recess, said inner element comprising a panel section, said panel section having a planar top surface and a planar bottom surface, said planar top surface further comprising an extension member, and a clutch plate said clutch plate further comprising an end wall that is received in said recess channel and is sized and shaped to be received in said recess channel and wherein a lip locking member on said end wall of said clutch engages said flange section on said outer shell to lock said clutch to said outer-shell and, and said extension member of said inner element is retained by the engagement of a flange section that passes through a circular opening of said clutch, wherein said clutch further comprises teeth that can engage opposite teeth on said top surface of said inner element.

* * * * *